US006959875B2

(12) United States Patent
Yabu et al.

(10) Patent No.: US 6,959,875 B2
(45) Date of Patent: Nov. 1, 2005

(54) HUMIDITY CONTROLLER

(75) Inventors: Tomohiro Yabu, Sakai (JP); Yoshimasa Kikuchi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/476,531

(22) PCT Filed: Oct. 22, 2002

(86) PCT No.: PCT/JP02/10966

§ 371 (c)(1),
(2), (4) Date: Nov. 3, 2003

(87) PCT Pub. No.: WO03/046441

PCT Pub. Date: Jun. 5, 2003

(65) Prior Publication Data

US 2004/0262408 A1 Dec. 30, 2004

(30) Foreign Application Priority Data

Nov. 26, 2001 (JP) ..... 2001-359561

(51) Int. Cl.[7] ..... F25D 17/06; F25D 23/00

(52) U.S. Cl. ..... 236/44 C; 62/94; 62/271; 165/7; 165/229

(58) Field of Search ..... 236/44 A, 44 C; 62/94, 176.6, 271, 176.1; 165/222, 223, 229

(56) References Cited

U.S. PATENT DOCUMENTS

| | | | | |
|---|---|---|---|---|
| 5,230,466 | A * | 7/1993 | Moriya et al. | 236/44 A |
| 5,937,667 | A * | 8/1999 | Yoho, Sr. | 62/271 |
| 6,415,859 | B1 * | 7/2002 | Kametani et al. | 165/229 |
| 2004/0000152 | A1 * | 1/2004 | Fischer | 62/94 |
| 2004/0123615 | A1 * | 7/2004 | Yabu | 62/271 |
| 2004/0129011 | A1 * | 7/2004 | Kikuchi et al. | 62/271 |
| 2004/0134210 | A1 * | 7/2004 | Yabu et al. | 62/271 |
| 2004/0250557 | A1 * | 12/2004 | Yabu et al. | 62/94 |

FOREIGN PATENT DOCUMENTS

| | | |
|---|---|---|
| JP | H2-100130 | 8/1990 |
| JP | 8-128681 | 5/1996 |
| JP | 2001-263764 | 9/2001 |

* cited by examiner

*Primary Examiner*—Marc Norman
(74) *Attorney, Agent, or Firm*—Shinjyu Global IP Counselors, LLP

(57) ABSTRACT

A humidity control apparatus is provided with two adsorbing elements. The humidity control apparatus alternately repeats a first operation for dehumidifying air in the first adsorbing element while regenerating the second adsorbing element and a second operation for dehumidifying air in the second adsorbing element while regenerating the first adsorbing element. The second air taken into the humidity control apparatus is formed of a mixture of room air and outside air. In the humidity control apparatus, a mixture ratio between the room air and the outside air in the second air is variable.

16 Claims, 8 Drawing Sheets

(a) First operation (b) Second operation

HUMIDITY CONTROLLER

TECHNICAL FIELD

The present invention relates to a humidity control apparatus for controlling a humidity of air.

BACKGROUND ART

A humidity control apparatus for controlling a humidity of air by using an adsorbent is known conventionally. For example, a combination of a humidity control apparatus of this type and an air conditioner is disclosed in Japanese Patent Application Laid-open No. 8-128681.

To put it concretely, the humidity control apparatus described in the above official gazette includes a disc-shaped absorbing rotor. The adsorbing rotor is disposed astride a flow path for room air and a flow path for outside air and is driven for rotation about its axis. In other words, a portion of the adsorbing rotor is in contact with the room air and the rest of the rotor is in contact with the outside air. The adsorbing rotor is provided with an adsorbent.

In the humidity control apparatus, the outside air is supplied to the adsorbing rotor and moisture in the outside air is adsorbed by the adsorbent. The heated room air is supplied to the adsorbing rotor and the moisture is desorbed from the adsorbent. The humidity control apparatus sends the room air humidified by the adsorbing rotor back into the room.

Problems to be Solved

However, there is a fear that sufficient humidifying performance cannot be obtained in the above humidity control apparatus. This point will be described. In the humidity control apparatus, the heated air is sent to the adsorbing rotor, the moisture is desorbed from the adsorbent, and the desorbed moisture is applied to the air to thereby humidify the air. At this time, the lower a relative humidity of the air introduced into the adsorbing rotor, the likelier it becomes that the moisture is desorbed from the adsorbent.

However, in the humidity control apparatus, the room air of a relatively high absolute humidity is heated and sent to the adsorbing rotor. Therefore, a relative humidity of the room air introduced into the adsorbing rotor after heating cannot be reduced sufficiently and there was a fear that an amount of moisture (i.e., an amount of humidification) desorbed from the adsorbent cannot be secured. If the relative humidity of the room air after heating is reduced so as to secure the amount of humidification, a temperature of the room air after heating has to be increased. As a result, energy required for heating increases and efficiency of the humidity control apparatus is reduced.

The invention has been accomplished in view of the above points and it is an object of the invention to provide a high-efficiency humidity control apparatus in which sufficient humidifying performance can be secured.

DISCLOSURE OF THE INVENTION

A first means to solve the problem and taken by the invention is applied to a humidity control apparatus for taking in air, for humidifying or dehumidifying the air, and for supplying the air into a room. The humidity control apparatus comprises adsorbing elements (81, 82, . . . ) in which a humidity-control-side passage (85) for bringing circulating air into contact with an adsorbent and a heater (92) for heating air supplied to the humidity-control-side passage (85) of the adsorbing elements (81, 82, . . . ) for regenerating the adsorbent. The humidity control apparatus carries out an adsorbing operation for introducing first air into the humidity-control-side passage (85) of the adsorbing elements (81, 82, . . . ) to cause the adsorbent to adsorb moisture in the first air and a regenerating operation for introducing second air which has been heated in the heater (92) into the humidity-control-side passage (85) of the adsorbing elements (81, 82, . . . ) to desorb the moisture from the adsorbent. The second air is formed of a mixture of room air and outside air.

According to a second means to solve the problem and taken by the invention, in the first means to solve the problem, the adsorbing elements (81, 82, . . . ) includes a cooling-side passage (86) through which cooling fluid for taking heat of adsorption generated in the humidity-control-side passage (85) during the adsorbing operation.

According to a third means to solve the problem and taken by the invention, in the second means to solve the problem, the second air passes through the cooling-side passage (86) of the adsorbing elements (81, 82, . . . ) as the cooling fluid and is then heated by the heater (92) and introduced into the humidity-control-side passage (85) of the adsorbing elements (81, 82, . . . ).

According to a fourth means to solve the problem and taken by the invention, in any one of the first to third means to solve the problem, a plurality of adsorbing elements (81, 82) are provided and a first operation for simultaneously carrying out the adsorbing operation by circulating the first air through the humidity-control-side passage (85) of the first adsorbing element (81) and the regenerating operation by circulating the second air through the humidity-control-side passage (85) of the second adsorbing element (82) and a second operation for simultaneously carrying out the adsorbing operation by circulating the first air through the humidity-control-side passage (85) of the second adsorbing element (82) and the regenerating operation by circulating the second air through the humidity-control-side passage (85) of the first adsorbing element (81) are alternately carried out.

According to a fifth means to solve the problem and taken by the invention, in any one of the first to third means to solve the problem, the one adsorbing element (200) is divided into a first portion (201) and the rest, i.e., a second portion (202) and the adsorbing element (200) is slid to thereby carry out a first operation for simultaneously introducing the first air into the humidity-control-side passage (85) of the first portion (201) as the adsorbing operation and introducing the second air into the humidity-control-side passage (85) of the second portion (202) as the regenerating operation and a second operation for simultaneously introducing the second air into the humidity-control-side passage (85) of the first portion (201) as the regenerating operation and introducing the first air into the humidity-control-side passage (85) of the second portion (202) as the adsorbing operation while alternately switching between the operations.

According to a sixth means to solve the problem and taken by the invention, in any one of the first to third means to solve the problem, the adsorbing element (250) is formed in a shape of a disc through which the humidity-control-side passage (85) passes in a thickness direction and is disposed in such an attitude as to extend across both a flow path for the first air and a flow path for the second air and the adsorbing element (250) rotates around its central axis, introduces the first air into the humidity-control-side passage (85) formed in a portion of the adsorbing element (250) as the adsorbing operation, and introduces the second air into humidity-control-side passage (85) formed in the rest of the adsorbing element (250) as the regenerating operation.

According to a seventh means to solve the problem and taken by the invention, in any one of the first to third means to solve the problem, a mixture ratio between the room air and the outside air in the second air is adjusted based on a temperature of the room air and a temperature of the outside air.

According to an eighth means to solve the problem and taken by the invention, in any one of the first to third means to solve the problem, a mixture ratio between the room air and the outside air in the second air is adjusted based on a relative humidity of the room air and a relative humidity of the outside air.

According to a ninth means to solve the problem and taken by the invention, in any one of the first to third means to solve the problem, a mixture ratio between the room air and the outside air in the second air is adjusted based on a temperature and a relative humidity of the room air and a temperature and a relative humidity of the outside air.

According to a tenth means to solve the problem and taken by the invention, in the second or third means to solve the problem, an operation in which the outside air is used as the first air is carried out and a mixture ratio between the room air and the outside air in the second air is adjusted based on a temperature of the room air and a temperature of the first air after flowing out of the adsorbing elements (81, 82, . . . ) during the operation.

According to an eleventh means to solve the problem and taken by the invention, in the second or third means to solve the problem, an operation in which the room air is used as the first air is carried out and a mixture ratio between the room air and the outside air in the second air is adjusted based on a temperature of the outside air and a temperature of the first air after flowing out of the adsorbing elements (81, 82, . . . ) during the operation.

A twelfth means to solve the problem and taken by the invention is applied to a humidity control apparatus for taking in air, for humidifying or dehumidifying the air, and for supplying the air into a room. The humidity control apparatus comprises adsorbing elements (311, 312) for bringing the air passing through the adsorbing elements (311, 312) into contact with an adsorbent and for heating or cooling the adsorbent by a heating medium. The humidity control apparatus carries out an adsorbing operation for supplying first air and the heating medium for cooling to the adsorbing elements (311, 312) to cause the adsorbent to adsorb moisture in the first air and a regenerating operation for supplying second air and the heating medium for heating to the adsorbing elements (311, 312) to desorb the moisture from the adsorbent. The second air is formed of a mixture of room air and outside air.

According to a thirteenth means to solve the problem and taken by the invention, in the twelfth means to solve the problem, a mixture ratio between the room air and the outside air in the second air is adjusted based on a temperature of the room air and a temperature of the outside air.

According to a fourteenth means to solve the problem and taken by the invention, in the twelfth means to solve the problem, a mixture ratio between the room air and the outside air in the second air is adjusted based on a relative humidity of the room air and a relative humidity of the outside air.

According to a fifteenth means to solve the problem and taken by the invention, in the twelfth means to solve the problem, a mixture ratio between the room air and the outside air in the second air is adjusted based on a temperature and a relative humidity of the room air and a temperature and a relative humidity of the outside air.

Operation

In the first means to solve the problem, in the humidity control apparatus, the adsorbing operation and the regenerating operation are carried out. In the adsorbing operation, the first air is introduced into the humidity-control-side passage (85) of the adsorbing element (81, 82, . . . ). The first air comes in contact with the adsorbent while flowing through the humidity-control-side passage (85) and water vapor in the first air is adsorbed by the adsorbent. On the other hand, in the regenerating operation, the second air heated by the heater (92) is introduced into the humidity-control-side passage (85) of the adsorbing elements (81, 82, . . . ). If the high-temperature second air comes in contact with the adsorbent, water vapor is desorbed from the adsorbent. In other words, the adsorbent is regenerated. The water vapor desorbed from the adsorbent is applied to the second air.

In the humidity control apparatus according to the present means to solve the problem, the second air is the mixture of the outside air and the room air. In other words, in the humidity control apparatus, the outside air and the room air are taken in, mixed, and then sent to the heater (92) and the adsorbing elements (81, 82, . . . ) as the second air.

The humidity control apparatus according to the present means to solve the problem dehumidifies or humidifies the air supplied into the room. In other words, the humidity control apparatus carries out an operation for supplying the first air from which water vapor has been taken by the adsorbing elements (81, 82, . . . ) and which has been dehumidified into the room or an operation for supplying the second air which has been applied with water vapor desorbed from the adsorbing elements (81, 82, . . . ) and which has been humidified into the room. The humidity control apparatus may carry out the operation for supplying the dehumidified first air into the room and the operation for supplying the humidified second air into the room while switching between the operations.

In the second means to solve the problem, the adsorbing elements (81, 82, . . . ) is provided with the cooling-side passage (86). In the cooling-side passage (86), the cooling fluid circulates in the adsorbing operation. In other words, when the water vapor in the first air is adsorbed by the adsorbent, heat of adsorption is generated. If the temperature of the first air is increased by the heat of adsorption and the relative humidity of the first air reduces, the water vapor in the first air becomes less likely to be adsorbed by the adsorbent. Therefore, the cooling fluid is circulated through the cooling-side passage (86) of the adsorbing elements (81, 82, . . . ) to cause the generated heat of adsorption to be absorbed by the cooling fluid. Thus, the increase in the temperature of the first air is suppressed to suppress the reduction of the relative humidity to thereby secure an amount of moisture adsorbed by the adsorbent.

In the third means to solve the problem, the second air which has passed the cooling-side passage (86) of the adsorbing elements (81, 82, . . . ) and the heater (92) in order is sent into the humidity-control-side passage (85) of the adsorbing elements (81, 82). In other words, in the present means to solve the problem, the second air is first introduced into the cooling-side passage (86) of the adsorbing elements (81, 82, . . . ). The second air flows through the cooling-side passage (86) as the cooling fluid and absorbs the heat of adsorption generated in the humidity-control-side passage (85). Then, the second air is further heated by the heater (92) and sent into the humidity-control-side passage (85).

In the fourth means to solve the problem, at least two adsorbing elements (81, 82, . . . ) are provided to the humidity control apparatus. The humidity control apparatus of the present means to solve the problem alternately carries out the first operation and the second operation. In the first operation, the adsorbing operation with regard to the first adsorbing element (81) is carried out and the regenerating operation with regard to the second adsorbing element (82) is carried out. On the other hand, in the second operation, in a manner reverse to the first operation, the adsorbing operation with regard to the second adsorbing element (82) is carried out and the regenerating operation with regard to the first adsorbing element (81) is carried out.

In the fifth means to solve the problem, the one adsorbing element (200) is divided into two portions. In the humidity control apparatus of the present means to solve the problem, the first operation and the second operation are carried out alternately. In the first operation, the adsorbing operation with regard to the first portion (201) of the adsorbing element (200) is carried out and the regenerating operation with regard to the second portion (202) is carried out. On the other hand, in the second operation, in a manner reverse to the first operation, the adsorbing operation with regard to the second portion (202) of the adsorbing element (200) is carried out and the regenerating operation with regard to the first portion (201) is carried out.

In the humidity control apparatus of the present means to solve the invention, the adsorbing element (200) is slid to switch between the first operation and the second operation. For example, the humidity control apparatus continues the first operation for a while in a state in which the first portion (201) of the adsorbing element (200) extends across the flow path for the first air and the second portion (202) extends across the flow path for the second air. Then, the adsorbing element (200) is moved to start the second operation in a state in which the first portion (201) extends across the flow path for the second air and the second portion (202) extends across the flow path for the first air. Then, after continuing the second operation for a while, the adsorbing element (200) is moved again to carry out the first operation.

In the sixth means to solve the problem, the adsorbing element (250) is formed in a disc shape. The adsorbing element (250) is formed with the humidity-control-side passage (85) which passes through the adsorbing element (250) in the thickness direction. The adsorbing element (250) is disposed in such an attitude as to extend across the flow path for the first air and the flow path for the second air and is driven for rotation around its central axis. With regard to the adsorbing element (250), the first air flows through the humidity-control-side passage (85) to carry out the adsorbing operation in the portion extending across the flow path for the first air. In the portion extending across the flow path for the second air, the second air flows through the humidity-control-side passage (85) to carry out the regenerating operation. By rotating the adsorbing element (250), the adsorbing operation and the regenerating operation are carried out simultaneously in parallel.

In the seventh and thirteenth means to solve the problem, the mixture ratio between the room air and the outside air forming the second air is variable. The mixture ratio between the room air and the outside air is adjusted in view of the temperatures of the room air and the outside air.

In the eighth and fourteenth means to solve the problem, the mixture ratio between the room air and the outside air forming the second air is variable. The mixture ratio between the room air and the outside air is adjusted in view of the relative humidities of the room air and the outside air.

In the ninth and fifteenth means to solve the problem, the mixture ratio between the room air and the outside air forming the second air is variable. The mixture ratio between the room air and the outside air is adjusted in view of the temperature and the relative humidity of the room air and the temperature and the relative humidity of the outside air. Here, if a temperature and a relative humidity of air are known, an absolute humidity of the air can be derived. Therefore, in the present means to solve the problem, by deriving the absolute humidity from the temperature and the relative humidity of the air by computing or the like, the mixture ratio between the room air and the outside air may be adjusted in view of the absolute humidities of the room air and the outside air.

In the tenth means to solve the problem, the mixture ratio between the room air and the outside air forming the second air is variable. In the present means to solve the problem, an operation in which the taken-in outside air is used as the first air and the first air is introduced into the humidity-control-side passage (85) of the adsorbing element (81, 82, . . . ) is carried out. However, the humidity control apparatus of the present means to solve the problem may carry out an operation other than this operation.

In the adsorbing elements (81, 82, . . . ) of the present means to solve the problem, the first air in the humidity-control-side passage (85) and cooling fluid in the cooling-side passage (86) carry out heat exchange with each other. Therefore, in view of performance of heat exchange of the adsorbing elements (81, 82, . . . ), the temperature of the first air before flowing out into the humidity-control-side passage (85), i.e., the temperature of the outside air can be assumed based on the temperature of the first air after flowing out of the humidity-control-side passage (85) of the adsorbing elements (81, 82, . . . ). Therefore, in the present means to solve the problem, by using the temperature of the first air after flowing out of the humidity-control-side passage (85) instead of the temperature of the outside air, the mixture ratio between the room air and the outside air is adjusted based on the temperature of the first air and the temperature of the room air.

In the eleventh means to solve the problem, the mixture ratio between the room air and the outside air forming the second air is variable. In the present means to solve the problem, an operation in which the taken-in room air is used as the first air and the first air is introduced into the humidity-control-side passage (85) of the adsorbing elements (81, 82, . . . ) is carried out. However, the humidity control apparatus of the present means to solve the problem may carry out an operation other than this operation.

In the adsorbing elements (81, 82, . . . ) of the present means to solve the problem, the first air in the humidity-control-side passage (85) and cooling fluid in the cooling-side passage (86) carry out heat exchange with each other. Therefore, in view of performance of heat exchange of the adsorbing elements (81, 82, . . . ), the temperature of the first air before flowing out into the humidity-control-side passage (85), i.e., the temperature of the room air can be assumed based on the temperature of the first air after flowing out of the humidity-control-side passage (85) of the adsorbing elements (81, 82, . . . ). Therefore, in the present means to solve the problem, by using the temperature of the first air after flowing out of the humidity-control-side passage (85) instead of the temperature of the room air, the mixture ratio between the room air and the outside air is adjusted based on the temperature of the first air and the temperature of the outside air.

In the twelfth means to solve the problem, the adsorbing operation and the regenerating operation are carried out in the humidity control apparatus. In the adsorbing operation, the first air and the heating medium for cooling are sent into the adsorbing elements (311, 312). In the adsorbing elements (311, 312) during the adsorbing operation, moisture in the first air is adsorbed by the adsorbent. The heat of adsorption generated at this time is absorbed by the heating medium for cooling. On the other hand, in the regenerating operation, the second air and the heating medium for heating are sent into the adsorbing elements (311, 312). In the adsorbing elements (311, 312) during the regenerating operation, the adsorbent is heated by the heating medium for heating and the moisture is desorbed from the adsorbent. In other words, the adsorbent is regenerated. The water vapor desorbed from the adsorbent is applied to the second air.

In the humidity control apparatus of the prevent means to solve the problem, the second air is the mixture of the outside air and the room air. In other words, in the humidity control apparatus, the outside air and the room air are taken in, mixed, and then sent to the heater (92) and the adsorbing elements (311, 312) as the second air.

The humidity control apparatus of the present means to solve the problem dehumidifies or humidifies the air supplied into the room. In other words, the humidity control apparatus carries out an operation for supplying the first air from which water vapor has been taken by the adsorbing elements (311, 312) and which has been dehumidified into the room or an operation for supplying the second air which has been applied with water vapor desorbed from the adsorbing elements (311, 312) and which has been humidified into the room. The humidity control apparatus may carry out the operation for supplying the dehumidified first air into the room and the operation for supplying the humidified second air into the room while switching between the operations.

Effects

In the invention, the second air sent to the adsorbing elements (81, 82, . . . ) for regenerating the adsorbent is the mixture of the room air and the outside air. Here, if only one of the room air and the outside air is used as the second air, the temperature and the humidity of the second air are uniquely determined by a state of the room air or the outside air. On the other hand, according to the invention, the mixture of the room air and the outside air is used as the second air. Consequently, the temperature and the humidity of the second air can be changed if necessary. Therefore, according to the invention, by appropriately setting a state of the second air, it is possible to keep efficiency of the humidity control apparatus high and to ensure sufficient performance of humidification.

In the second means to solve the problem, the cooling-side passage (86) is formed in the adsorbing elements (81, 82, . . . ) to cause the cooling fluid to absorb the heat of adsorption generated in the adsorbing operation. Therefore, according to the present means to solve the problem, it is possible to suppress an increase in a temperature of the first air due to the generated heat of adsorption. As a result, a relative humidity of the first air flowing through the humidity-control-side passage (85) of the adsorbing elements (81, 82, . . . ) can be maintained at a high value and an amount of water vapor adsorbed by the adsorbent can be increased.

In the third means to solve the problem, the second air is first introduced into the cooling-side passage (86) of the adsorbing elements (81, 82, . . . ) as the cooling fluid and the second air flowing out of the cooling-side passage (86) is heated by the heater (92). In other words, the second air used for regeneration of the adsorbing elements (81, 82, . . . ) is heated not only in the heater (92) but also in the cooling-side passage (86) of the adsorbing elements (81, 82, . . . ). Therefore, according to the present means to solve the problem, an amount of heat which should be given to the second air by the heater (92) can be reduced and energy required for operation of the humidity control apparatus can be reduced.

In the twelfth means to solve the problem, the heating medium for cooling is introduced into the adsorbing elements (311, 312, . . . ) in the adsorbing operation to cause the heating medium to absorb the heat of adsorption generated in the adsorbing operation. Therefore, according to the present means to solve the problem, it is possible to suppress an increase in a temperature of the first air due to the generated heat of adsorption. As a result, a relative humidity of the first air passing through the adsorbing elements (311, 312, . . . ) can be maintained at a high value and an amount of water vapor adsorbed by the adsorbent can be increased.

Especially in the seventh to eleventh and thirteenth and fifteenth means to solve the problem, the mixture ratio between the room air and the outside air forming the second air is appropriately adjusted by using various parameters. Therefore, according to these means to solve the problem, a state of the second air used for regeneration of the adsorbent can be set further appropriately to thereby enhance efficiency and performance of humidification of the humidity control apparatus.

BEST MODE FOR CARRYING OUT THE INVENTION

Figure 1:
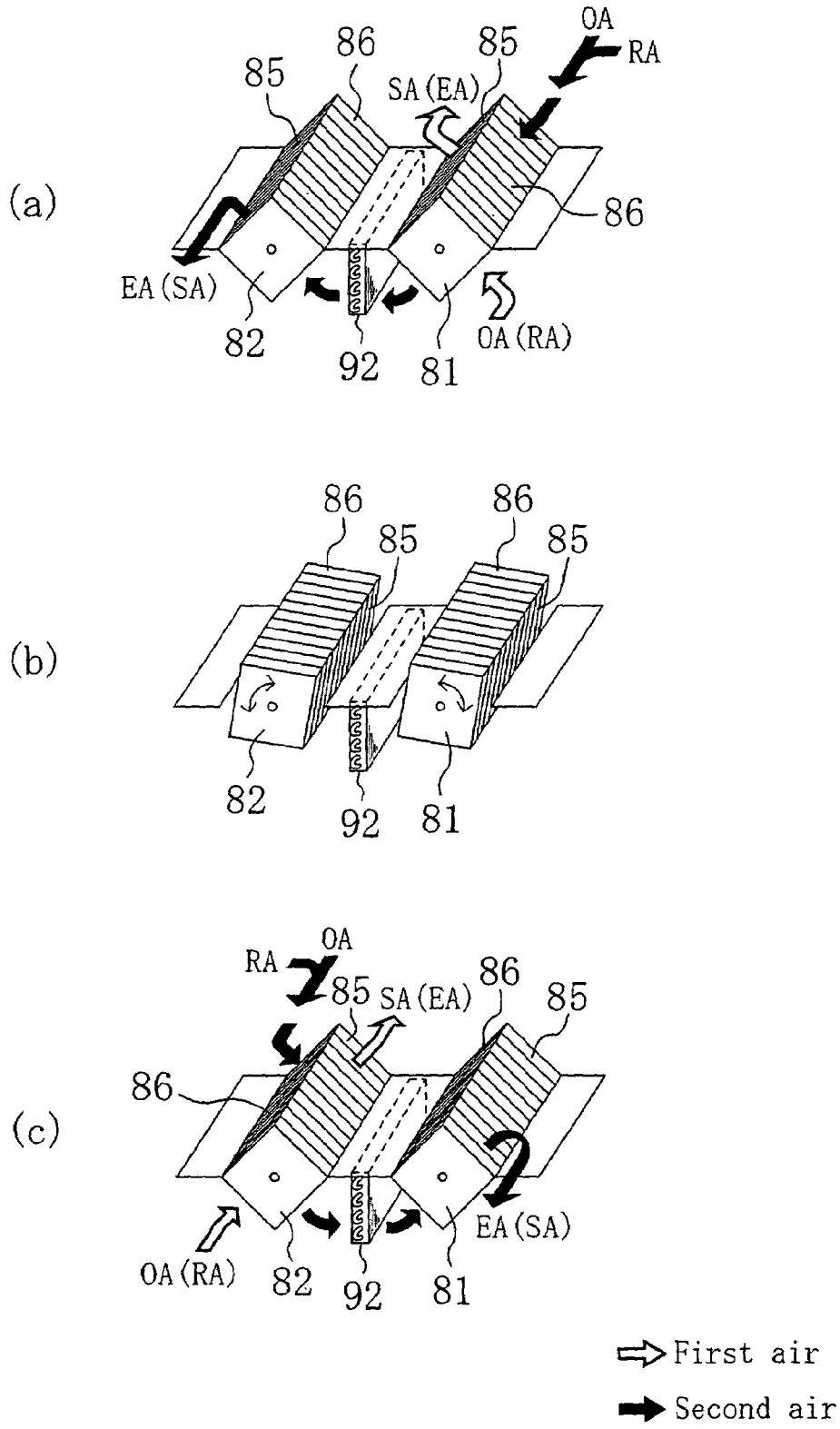
FIGS. 1(*a*) to 1(*c*) are schematic perspective view showing a structure of an essential portion of a humidity control apparatus according to an embodiment 1.

Embodiments of the present invention will be described below in detail based on the drawings. In the following description, words, "upper", "lower", "left", "right", "forward", "backward", "front", "back" mean directions in the drawings which are referred to.

<Embodiment 1 of the Invention>

A humidity control apparatus according to the embodiment 1 is formed to carry out a dehumidifying operation for supplying dehumidified and cooled outside air into a room and a humidifying operation for supplying heated and humidified outside air into the room while switching between the operations. The humidity control apparatus includes two adsorbing elements (81, 82) and carries out an operation of a so-called batch type.

As shown in FIG. 1, the respective adsorbing elements (81, 82) are formed into shapes of square columns. Specific structures of the adsorbing elements (81, 82) will be described later. The two adsorbing elements (81, 82) are arranged on the left and right and housed in a casing outside the drawing.

To put it concretely, in the casing of the humidity control apparatus, the first adsorbing element (81) is disposed on the right side and the second adsorbing element (82) is disposed on the left side. These adsorbing elements (81, 82) are disposed such that their longitudinal directions are parallel to each other. These adsorbing elements (81, 82) are disposed in such attitudes that their end faces form rhombuses formed by rotating squares by 45°. In other words, the respective adsorbing elements (81, 82) are disposed in such attitudes that ones of diagonal lines of the end faces are in a straight line. Furthermore, the respective adsorbing elements (81, 82) are disposed to be rotatable around axes passing through centers of the end faces.

Spaces on the left and right of the respective adsorbing elements (81, 82) are respectively partitioned into upper and lower spaces. In a portion between both the adsorbing elements (81, 82) in the lower space out of these upper and lower spaces, a regenerative heat exchanger (92) is disposed. The regenerative heat exchanger (92) is disposed in such an attitude that its longitudinal direction is parallel to the longitudinal directions of the adsorbing elements (81, 82). The regenerative heat exchanger (92) is connected to a refrigerant circuit outside the drawing. The refrigerant circuit includes a compressor and the like, is filled with a refrigerant, and carries out a vapor-compression refrigeration cycle by circulating the refrigerant. In the refrigeration cycle of the refrigerant circuit, the regenerative heat exchanger (92) functions as a condenser for the refrigerant.

Figure 2:
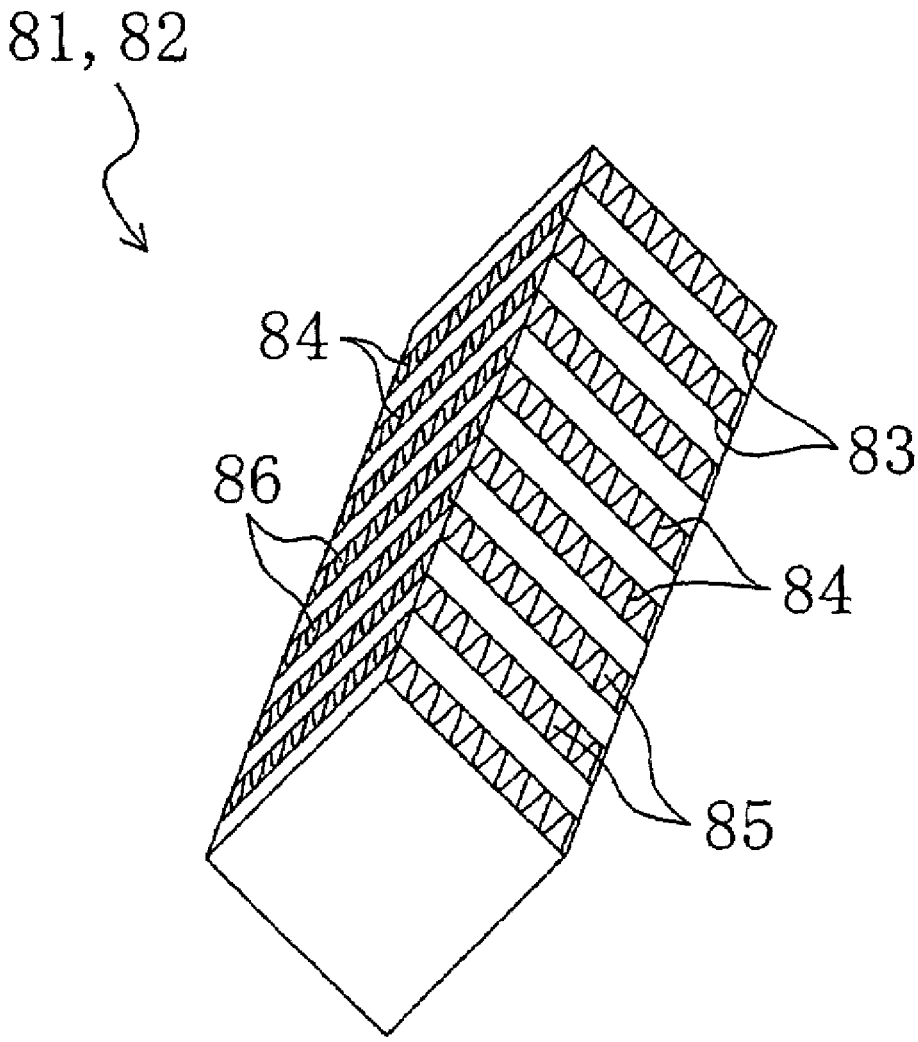
FIG. 2 is a schematic perspective view showing an adsorbing element of the humidity control apparatus according to the embodiment 1.

As shown in FIG. 2, the adsorbing elements (81, 82) are formed by alternately laminating square flat plate members (83) and corrugated plate members (84). The corrugated plate members (84) are laminated in such attitudes that ridge line directions of the adjacent corrugated plate members (84) are displaced from each other by 90°. The adsorbing elements (81, 82) are formed into shapes of square columns. In other words, the end faces of the respective adsorbing elements (81, 82) are formed into squares similar to the flat plate members (83).

In the adsorbing elements (81, 82), humidity-control-side passages (85) and cooling-side passages (86) are defined alternately in a direction of layers of the flat plate members (83) and corrugated plate members (84) such that each the flat plate member (83) is sandwiched between the humidity-control-side passages (85) and cooling-side passages (86). In the adsorbing elements (81, 82), the humidity-control-side passages (85) are open in a pair of opposed side faces and the cooling-side passages (86) are open in the other pair of opposed side faces. Surfaces of the flat plate members (83) facing the humidity-control-side passages (85) and surfaces of the corrugated plate members (84) provided in the humidity-control-side passages (85) are coated with an adsorbent for adsorbing water vapor. As this type of adsorbent, silica gel, zeolite, ion-exchange resin, and the like can be employed, for example.

In the casing of the humidity control apparatus, air flow paths through which first air and second air flow are formed. In the casing, a damper mechanism for switching a circulating route of air and a fan for circulating air through the air flow paths are housed (not shown). The humidity control apparatus is formed as follows by including the damper mechanism.

To put it concretely, the humidity control apparatus can switch between a state in which the first air and the second air are sent to the first adsorbing element (81) and a state in which the first air and the second air are sent to the second adsorbing element (82). The humidity control apparatus can switch between a state in which outside air is taken in as the first air and supplied into the room after passing through the adsorbing elements (81, 82) and a state in which room air is taken in as the first air and discharged outside the room after passing through the adsorbing elements (81, 82). The humidity control apparatus takes in the room air and outside air and uses a mixture of them as second air. The humidity control apparatus can switch between a state in which the second air flowing out of the adsorbing elements (81, 82) is discharged outside the room and a state in which the second air is supplied into the room.

The humidity control apparatus is provided with a temperature sensor for detecting a temperature of the room air and a temperature sensor for detecting a temperature of the outside air. The humidity control apparatus adjusts a mixture ratio between the room air and the outside air in the second air based on temperatures detected by both the temperature sensors.

Operation

As described above, the humidity control apparatus takes in the first air and the second air and carries out the dehumidifying operation and the humidifying operation while switching between the operations. The humidity control apparatus carries out the dehumidifying operation and the humidifying operation by alternately repeating a first operation and a second operation.

The humidity control apparatus takes in the outside air as the first air during the dehumidifying operation and takes in the room air as the first air during the humidifying operation. On the other hand, the humidity control apparatus uses a mixture of the room air and the outside air as the second air during both the dehumidifying operation and the humidifying operation.

<<First Operation>>

In the first operation, an adsorbing operation with regard to the first adsorbing element (81) and a regenerating operation with regard to the second adsorbing element (82) are carried out. In other words, in the first operation, the first air is dehumidified by the first adsorbing element (81) and the adsorbent in the second adsorbing element (82) is regenerated.

As shown in FIG. 1(*a*), in the first operation, the first adsorbing element (81) and the second adsorbing element

(82) are in such attitudes that side faces in which the humidity-control-side passages (85) are open are positioned on upper left sides and lower right sides and that side faces in which the cooling-side passages (86) are open are positioned on upper right sides and lower left sides.

In this state, the first air is introduced from a lower right side face of the first adsorbing element (81) into the humidity-control-side passages (85). In the humidity-control-side passages (85), the first air flows from the lower right side toward the upper left side and water-vapor included in the first air is adsorbed by the adsorbent. The first air dehumidified in the humidity-control-side passages (85) flows out of the upper left side face of the first adsorbing element (81). The first air flowing out of the first adsorbing element (81) is supplied into the room during the dehumidifying operation and is discharged outside the room during the humidifying operation.

On the other hand, the second air is introduced from the upper right side face of the first adsorbing element (81) into the cooling-side passages (86). In the cooling-side passages (86), the second air flows from the upper right side toward the lower left side and absorbs heat of adsorption generated in the humidity-control-side passages (85). In other words, the second air flows through the cooling-side passages (86) as cooling fluid. Then, the second air flows out of the first adsorbing element (81) and is sent to the regenerative heat exchanger (92). In the regenerative heat exchanger (92), the second air is heated by heat exchange with the refrigerant.

The second air heated in the first adsorbing element (81) and the regenerative heat exchanger (92) is introduced from the lower right side face of the second adsorbing element (82) into the humidity-control-side passages (85). In the humidity-control-side passages (85), the second air flows from the lower right side toward the upper left side. In the humidity-control-side passages (85), the adsorbent is heated by the second air and water vapor is desorbed from the adsorbent. In other words, regeneration of the adsorbent is carried out. Water vapor desorbed from the adsorbent flows out of the second adsorbing element (82) together with the second air. The second air to which water vapor is applied in the second adsorbing element (82) is discharged outside the room during the dehumidifying operation and supplied into the room during the humidifying operation.

<<Second Operation>>

The first operation is continued for a while and then, the second operation is carried out. In the second operation, an adsorbing operation with regard to the second adsorbing element (82) and a regenerating operation with regard to the first adsorbing element (81) ate carried out.

In order to switch from the first operation to the second operation, the first adsorbing element (81) and the second adsorbing element (82) are rotated by 90° as shown in FIG. 1(*b*). As shown in FIG. 1(*c*), the first adsorbing element (81) and the second adsorbing element (82) are in such attitudes that the side faces in which the humidity-control-side passages (85) are open are positioned on the upper right sides and the lower left sides and that the side faces in which the cooling-side passages (86) are open are positioned on the upper left sides and the lower right sides.

In this state, the first air is introduced from the lower left side face of the second adsorbing element (82) into the humidity-control-side passages (85). In the humidity-control-side passages (85), the first air flows from the lower left side toward the upper right side and water vapor included in the first air is adsorbed by the adsorbent. The first air dehumidified in the humidity-control-side passages (85) flows out from the upper right side face of the second adsorbing element (82). The first air flowing out of the second adsorbing element (82) is supplied into the room during the dehumidifying operation and discharged outside the room during the humidifying operation.

On the other hand, the second air is introduced from the upper left side face of the second adsorbing element (82) into the cooling-side passages (86). In the cooling-side passages (86), the second air flows from the upper left side toward the lower right side and absorbs heat of adsorption generated in the humidity-control-side passages (85). In other words, the second air flows through the cooling-side passages (86) as cooling fluid. Then, the second air flows out of the first adsorbing element (81) and is sent to the regenerative heat exchanger (92). In the regenerative heat exchanger (92), the second air is heated by heat exchange with the refrigerant.

The second air heated in the second adsorbing element (82) and the regenerative heat exchanger (92) is introduced from the lower left side face of the first adsorbing element (81) into the humidity-control-side passages (85). In the humidity-control-side passages (85), the second air flows from the lower left side toward the upper right side. In the humidity-control-side passages (85), the adsorbent is heated by the second air and water vapor is desorbed from the adsorbent. In other words, regeneration of the adsorbent is carried out. The water vapor desorbed from the adsorbent flows out of the first adsorbing element (81) together with the second air. The second air to which water vapor is applied in the first adsorbing element (81) is discharged outside the room during the dehumidifying operation and supplied into the room during the humidifying operation.

As described above, the first air is dehumidified in the second adsorbing element (82) and the adsorbent in the first adsorbing element (81) is regenerated in the second operation. After the second operation is continued for a while, the first operation is carried out again.

<<Operation for Adjusting the Mixture Ratio>>

As described above, the mixture of the room air and the outside air is used as the second air in the above humidity control apparatus. In the humidity control apparatus, the mixture ratio between the room air and the outside air in the second air is adjusted based on temperatures of the room air and the outside air.

For example, in order to secure an amount of humidification during the humidifying operation, it is required that an absolute humidity of the second air supplied into the room is increased to be as high as possible. In general, it is assumed that, the higher a temperature of air, the higher an absolute humidity of the air is. Therefore, in such a case, a proportion of one of the room air and the outside air of a higher temperature is increased so as to increase the absolute humidity of the second air.

In order to reduce an amount of heating in the regenerative heat exchanger (92) to reduce energy consumption of the humidity control apparatus, the higher temperature of the second air is advantageous. Therefore, in such a case, a proportion of one of the room air and the outside air of a higher temperature is increased so as to increase the temperature of the second air.

Effects of the Embodiment 1

In the present embodiment, the mixture of the room air and the outside air is employed as the second air and the mixture ratio between the room air and the outside air is variable. Here, if only one of the room air and the outside air is used as the second air, the temperature and the humidity of the second air are uniquely determined by a state of the room air or the outside air. On the other hand, according to the embodiment, by adjusting the mixture ratio between the room air and the outside air constituting the second air, the temperature and the humidity of the second air can be changed if necessary. Therefore, according to the embodiment, by appropriately setting a state of the second air, it is possible to enhance efficiency of the humidity control apparatus and to ensure performance of the humidity control apparatus for controlling the humidity.

In the embodiment, the cooling-side passages (86) are formed in the adsorbing elements (81, 82) to cause the second air to absorb the heat of adsorption generated in the adsorbing operation. Therefore, according to the embodiment, it is possible to suppress an increase in a temperature of the first air due to the generated heat of adsorption. As a result, a relative humidity of the first air flowing through the humidity-control-side passages (85) of the adsorbing elements (81, 82) can be maintained at a high value and an amount of water vapor adsorbed by the adsorbent can be increased.

In the embodiment, the second air is first introduced into the cooling-side passages (86) of the adsorbing elements (81, 82) as the cooling fluid and the second air flowing out of the cooling-side passages (86) is heated by the regenerative heat exchanger (92). In other words, the second air used for regeneration of the adsorbing elements (81, 82) is heated not only by the regenerative heat exchanger (92) but also by the heat of adsorption generated in the adsorbing elements (81, 82). Therefore, according to the embodiment, an amount of heat which should be given to the second air by the regenerative heat exchanger (92) can be reduced and energy required for operation of the humidity control apparatus can be reduced.

<Embodiment 2 of the Invention>

A humidity control apparatus according to the embodiment includes two adsorbing elements (81, 82), carries out an operation of a batch type, and is formed to carry out a dehumidifying operation and a humidifying operation while switching between the operations. In the humidity control apparatus, the second air is formed of a mixture of room air and outside air and a mixture ratio between the room air and the outside air in the second air is adjusted based on temperatures of room and outside air, which is similar to the above embodiment 1.

In the humidity control apparatus of the present embodiment, however, a switch between a first operation and a second operation is carried out while keeping the adsorbing elements (81, 82) fixed. Here, structures of the humidity control apparatus of the embodiment which are different from those of the embodiment 1 will be described.

Figure 3:
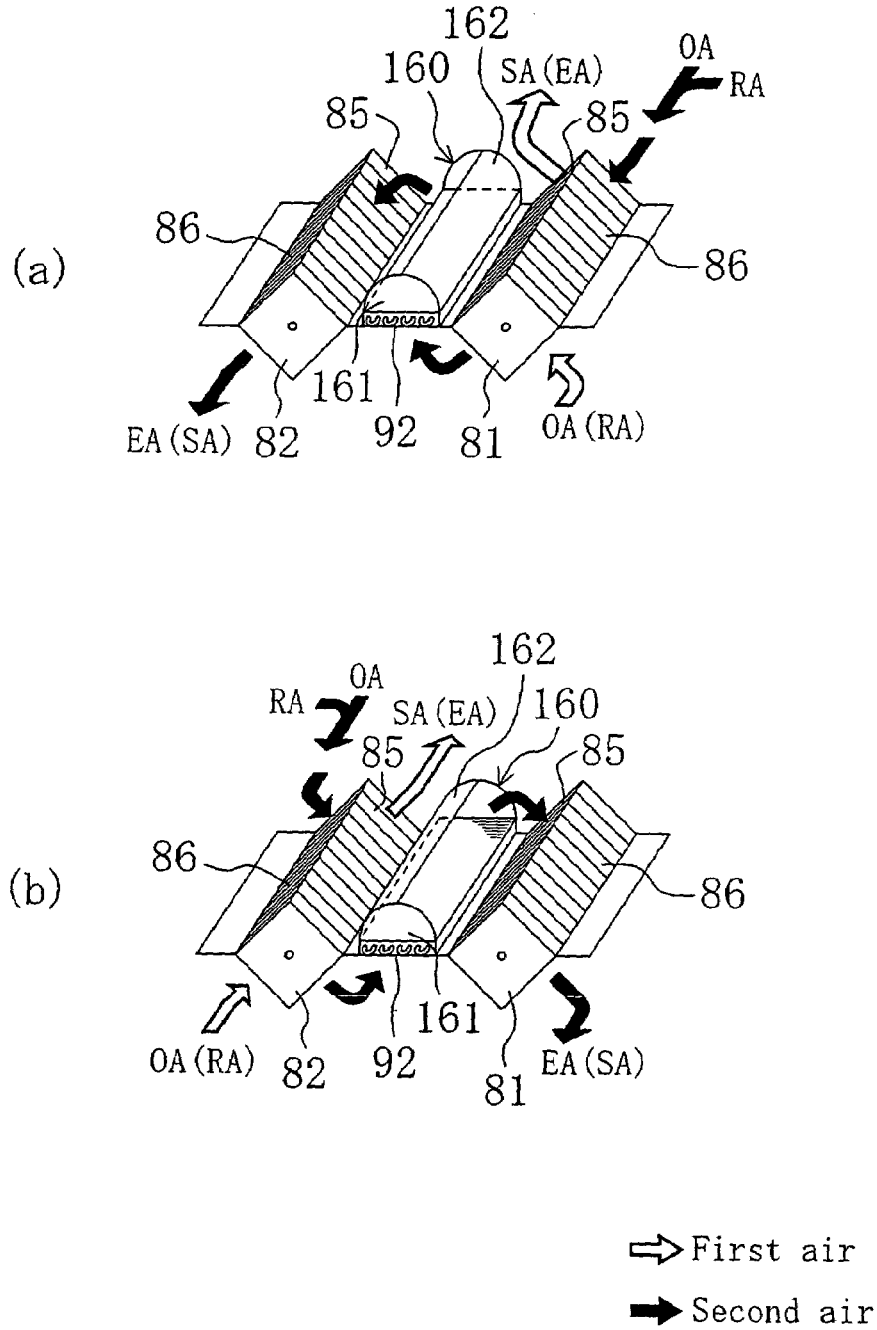
FIGS. 3(*a*) and 3(*b*) are schematic perspective view showing a structure of an essential portion of a humidity control apparatus according to an embodiment 2.

As shown in FIG. 3, the two adsorbing elements (81, 82) are arranged on the left and right in a casing of the humidity control apparatus, which is similar to the embodiment 1. Structures of the respective adsorbing elements (81, 82) are similar to those of the embodiment 1. The first adsorbing element (81) positioned on the right side is disposed in such an attitude that side faces in which humidity-control-side passages (85) are open are positioned on an upper left side and a lower right side and that side faces in which cooling-side passages (86) are open are positioned on an upper right side and a lower left side. On the other hand, the second adsorbing element (82) positioned on the left side is disposed in such an attitude that side faces in which humidity-control-side passages (85) are open are positioned on an upper right side and a lower left side and that side faces in which cooling-side passages (86) are open are positioned on an upper left side and a lower right side.

Spaces on the left and right of the respective adsorbing elements (81, 82) are respectively partitioned into upper and lower spaces, which is similar to the embodiment 1. In the embodiment, the regenerative heat exchanger (92) is disposed substantially in a horizontal attitude between the first adsorbing element (81) and the second adsorbing element (82). In other words, upper and lower portions of the space between both the adsorbing elements (81, 82) communicate with each other through the regenerative heat exchanger (92).

On the regenerative heat exchanger (92), a switching shutter (160) is disposed to cover the regenerative heat exchanger (92). The switching shutter (160) has a shutter plate (162) and a pair of side plates (161).

Each the side plate (161) is formed in a shape of a semicircular plate. A diameter of each the side plate (161) is substantially the same as a lateral width of the regenerative heat exchanger (92). One side plate (161) is provided along each of end faces on front and back sides of the regenerative heat exchanger (92). On the other hand, the shutter plate (162) is formed in a shape of a curved plate extending from the one side plate (161) to the other and curved along peripheral edges of the respective side plates (161). A central angle of a curved surface of the shutter plate (162) is 90° and the shutter plate (162) covers a half portion of the regenerative heat exchanger (92) in a lateral direction. The shutter plate (162) moves along peripheral edges of the side plates (161).

The switching shutter (160) is switched between a state in which the shutter plate (162) covers a right half of the regenerative heat exchanger (92) (see FIG. 3(*a*)) and a state in which the shutter plate (162) covers a left half of the regenerative heat exchanger (92) (see FIG. 3(*b*)).

Operation

As described above, the humidity control apparatus takes in the first air and the second air and carries out the dehumidifying operation and the humidifying operation while switching between the operations. The humidity control apparatus carries out the dehumidifying operation and the humidifying operation by alternately repeating a first operation and a second operation.

The humidity control apparatus takes in the outside air as the first air during the dehumidifying operation and takes in the room air as the first air during the humidifying operation. On the other hand, the humidity control apparatus uses a mixture of the room air and the outside air as the second air during both the dehumidifying operation and humidifying operation. Operation for adjusting mixture of the room air and the outside air is similar to that in the embodiment 1.

<<First Operation>>

In the first operation, an adsorbing operation with regard to the first adsorbing element (81) and a regenerating operation with regard to the second adsorbing element (82) are carried out. In other words, in the first operation, moisture in the first air is adsorbed by the first adsorbing element (81) and moisture desorbed from the second adsorbing element (82) is applied to the second air.

As shown in FIG. 3(*a*), during the first operation, the shutter plate (162) is in such a position as to cover the right half of the regenerative heat exchanger (92) in the switching shutter (160). In this state, the cooling-side passages (86) of the first adsorbing element (81) and the humidity-control-side passages (85) of the second adsorbing element (82) communicate with each other.

The first air is introduced from the lower right side face of the first adsorbing element (81) into the humidity-control-side passages (85). In the humidity-control-side passages (85), the first air flows from the lower right side toward the upper left side and water vapor included in the first air is adsorbed by the adsorbent. The first air dehumidified in the humidity-control-side passages (85) flows out of the upper left side face of the first adsorbing element (81). The first air flowing out of the first adsorbing element (81) is supplied into the room during the dehumidifying operation and is discharged outside the room during the humidifying operation.

On the other hand, the second air is introduced from the upper right side face of the first adsorbing element (81) into the cooling-side passages (86). In the cooling-side passages (86), the second air flows from the upper right side toward the lower left side and absorbs heat of adsorption generated in the humidity-control-side passages (85). In other words, the second air flows through the cooling-side passages (86) as cooling fluid. Then, the second air flows out of the first adsorbing element (81) and is sent to the regenerative heat exchanger (92). In the regenerative heat exchanger (92), the second air is heated by heat exchange with the refrigerant.

The second air heated in the first adsorbing element (81) and the regenerative heat exchanger (92) is introduced from the upper right side face of the second adsorbing element (82) into the humidity-control-side passages (85). In the humidity-control-side passages (85), the second air flows from the upper right side toward the lower left side. In the humidity-control-side passages (85), the adsorbent is heated by the second air and water vapor is desorbed from the adsorbent. In other words, regeneration of the adsorbent is carried out. Water vapor desorbed from the adsorbent flows out of the second adsorbing element (82) together with the second air. The second air to which water vapor is applied in the second adsorbing element (82) is discharged outside the room during the dehumidifying operation and supplied into the room during the humidifying operation.

<<Second Operation>>

The first operation is continued for a while and then, the second operation is carried out. In the second operation, an adsorbing operation with regard to the second adsorbing element (82) and a regenerating operation with regard to the first adsorbing element (81) are carried out.

In order to switch from the first operation to the second operation, the shutter plate (162) of the switching shutter (160) moves to such a position as to cover the left half of the regenerative heat exchanger (92). As shown in FIG. 3(*b*), the cooling-side passages (86) of the second adsorbing element (82) and the humidity-control-side passages (85) of the first adsorbing element (81) communicate with each other in this state.

The first air is introduced from the lower left side face of the second adsorbing element (82) into the humidity-control-side passages (85). In the humidity-control-side passages (85), the first air flows from the lower left side toward the upper right side and water vapor included in the first air is adsorbed by the adsorbent. The first air dehumidified in the humidity-control-side passages (85) flows out from the upper right side face of the first adsorbing element (81). The first air flowing out of the second adsorbing element (82) is supplied into the room during the dehumidifying operation and discharged outside the room during the humidifying operation.

On the other hand, the second air is introduced from the upper left side face of the second adsorbing element (82) into the cooling-side passages (86). In the cooling-side passages (86), the second air flows from the upper left side toward the lower right side and absorbs heat of adsorption generated in the humidity-control-side passages (85). In other words, the second air flows through the cooling-side passages (86) as cooling fluid. Then, the second air flows out of the second adsorbing element (82) and is sent to the regenerative heat exchanger (92). In the regenerative heat exchanger (92), the second air is heated by heat exchange with the refrigerant.

The second air heated in the second adsorbing element (82) and the regenerative heat exchanger (92) is introduced from the upper left side face of the first adsorbing element (81) into the humidity-control-side passages (85). In the humidity-control-side passages (85), the second air flows from the upper left side toward the lower right side. In the humidity-control-side passages (85), the adsorbent is heated by the second air and water vapor is desorbed from the adsorbent. In other words, regeneration of the adsorbent is carried out. The water vapor desorbed from the adsorbent flows out of the first adsorbing element (81) together with the second air. The second air to which water vapor is applied in the first adsorbing element (81) is discharged outside the room during the dehumidifying operation and supplied into the room during the humidifying operation.

As described above, the first air is dehumidified in the second adsorbing element (82) and the adsorbent in the first adsorbing element (81) is regenerated in the second operation. After the second operation is continued for a while, the first operation is carried out again.

<Embodiment 3 of the Invention>

A humidity control apparatus according to the embodiment 3 of the invention includes one adsorbing element (200). The humidity control apparatus takes in the first air and the second air and carries out a dehumidifying operation or a humidifying operation while alternately carrying out a first operation and a second operation.

Figure 4:
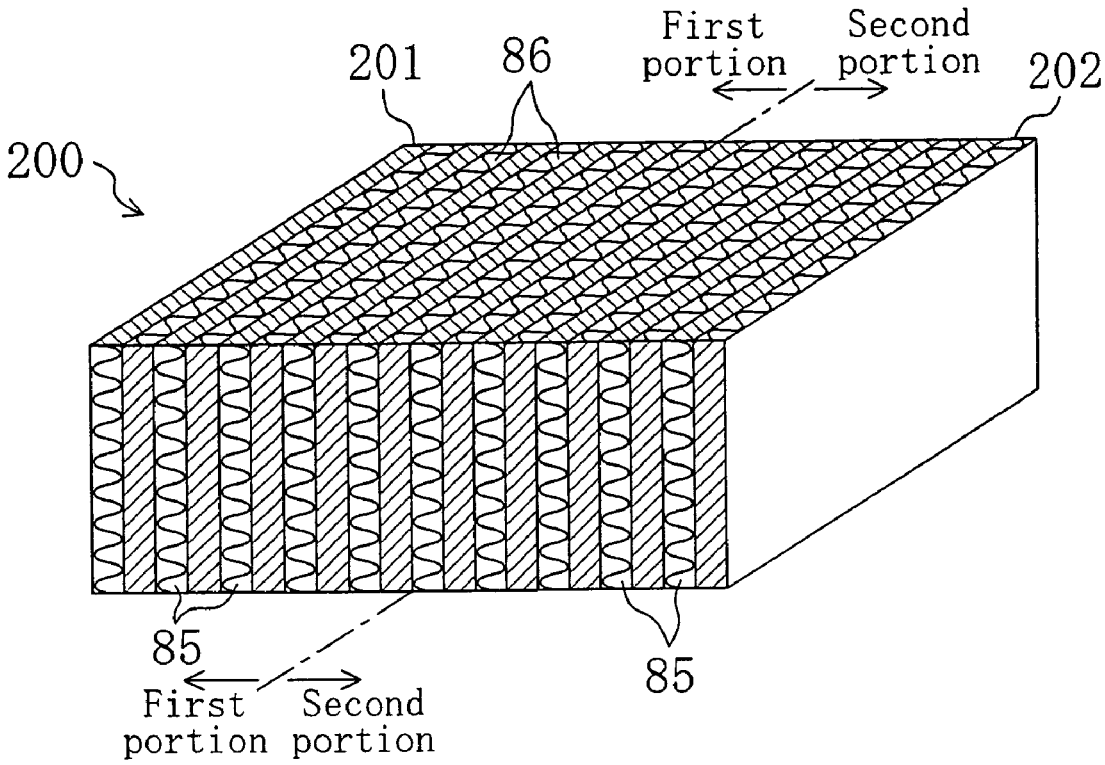
FIG. 4 is a schematic perspective view showing an adsorbing element of a humidity control apparatus according to an embodiment 3.

As shown in FIG. 4, the adsorbing element (200) of the present embodiment is formed by alternately laminating rectangular flat plate members (83) and corrugated plate members (84). The adsorbing element (200) is formed similarly to that of the embodiment 1 except its entire shape.

To put it concretely, the adsorbing element (200) is formed in a shape of a rectangular parallelepiped which is long in a lateral direction and rather flat as a whole. In this adsorbing element (200), the flat plate members (83) and the corrugated plate members (84) are laminated in a longitudinal direction. Humidity-control-side passages (85) are open in front and back faces in FIG. 4 and cooling-side passages (86) are open in upper and lower faces in FIG. 4. The adsorbing element (200) is divided into a first portion (201) and a second portion (202). In other words, a left half of the adsorbing element (200) is the first portion (201) and a right half is the second portion (202).

Figure 5:
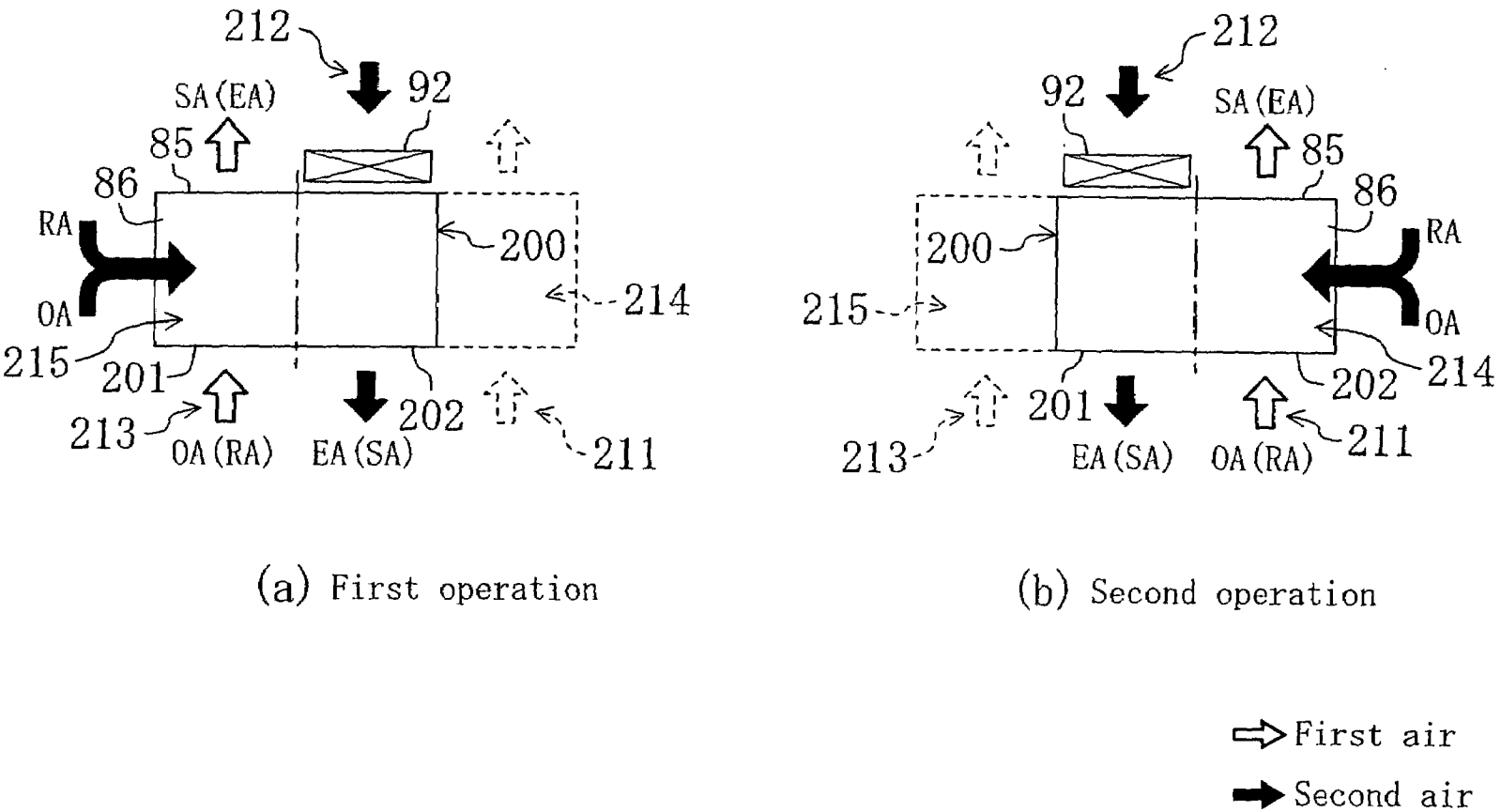
FIGS. 5(*a*) and 5(*b*) are schematic block diagram showing a structure of a humidity control apparatus according to the embodiment 3.

As shown in FIG. 5, in the humidity control apparatus of the embodiment, a right air flow path (211), a central air flow path (212), and a left air flow path (213) are formed in parallel to each other. Through the right air flow path (211) and the left air flow path (213), the first air circulates from below upward in FIG. 5. Through the central air flow path (212), the second air circulates from above downward in FIG. 5. In the humidity control apparatus, a right cooling air flow path (214) and a left cooling air flow path (215) are formed. The right cooling air flow path (214) is formed to be orthogonal to the right air flow path (211). The left cooling air flow path (215) is formed to be orthogonal to the left air flow path (213).

The adsorbing element (200) is disposed in such an attitude as to be orthogonal to the respective air flow paths and as to be able to slide leftward and rightward in FIG. 5. To put it concretely, by linearly moving in a longitudinal direction, the adsorbing element (200) is switched between a state in which the first portion (201) extends across the left air flow path (213) and the left cooling air flow path (215) and the second portion (202) extends across the central air flow path (212) and a state in which the first portion (201) extends across the central air flow path (212) and the second portion (202) extends across the right air flow path (211) and the right cooling air flow path (214).

The regenerative heat exchanger (92) which is a heater is provided upstream from the adsorbing element (200) in the central air flow path (212). The regenerative heat exchanger (92) is connected to a refrigerant circuit of a refrigerator and functions as a condenser for the refrigerant.

In the humidity control apparatus, a mixture of room air and outside air is used as the second air. The humidity control apparatus is provided with a temperature sensor for detecting a temperature of the room air and a temperature sensor for detecting a temperature of the outside air. The humidity control apparatus adjusts a mixture ratio between the room air and the outside air constituting the second air based on temperatures detected by both the temperature sensors. In these points, the embodiment is similar to the above embodiment 1.

Operation

As described above, the humidity control apparatus takes in the first air and the second air and carries out the dehumidifying operation and the humidifying operation while switching between the operations. The humidity control apparatus carries out the dehumidifying operation and the humidifying operation by alternately repeating a first operation and a second operation.

The humidity control apparatus takes in the outside air as the first air during the dehumidifying operation and takes in the room air as the first air during the humidifying operation. On the other hand, the humidity control apparatus uses the mixture of the room air and the outside air as the second air during both the dehumidifying and humidifying operations. Operation for adjusting mixture of the room air and the outside air is similar to that in the embodiment 1.

<<First Operation>>

In the first operation, an adsorbing operation with regard to the first portion (201) of the adsorbing element (200) and a regenerating operation with regard to the second portion (202) are carried out. In other words, in the first operation, moisture in the first air is adsorbed by the first portion (201) of the adsorbing element (200) and moisture desorbed from the second portion (202) is applied to the second air.

As shown in FIG. 5(*a*), during the first operation, the adsorbing element (200) is in a state in which the first portion (201) extends across the left air flow path (213) and the left cooling air flow path (215) and the second portion (202) extends across the central air flow path (212).

In this state, in the first portion (201) of the adsorbing element (200), the first air is introduced into the humidity-control-side passages (85) and the second air is introduced into the cooling-side passages (86). In the humidity-control-side passages (85) of the first portion (201), water vapor included in the first air is adsorbed by the adsorbent. The first air dehumidified in the humidity-control-side passages (85) of the first portion (201) is sent to the left air flow path (213).

When the water vapor is adsorbed by the adsorbent in the humidity-control-side passages (85), heat of adsorption is generated. This heat of adsorption is absorbed by the second air flowing through the cooling-side passages (86) of the first portion (201). In other words, the second air flows through the cooling-side passages (86) as cooling fluid.

The second air which has absorbed the heat of adsorption in the humidity-control-side passages (85) of the first portion (201) further absorbs heat of condensation of the refrigerant in the regenerative heat exchanger (92) and is introduced into the humidity-control-side passages (85) of the second portion (202). In other words, the second air is heated both in the cooling-side passages (86) of the first portion (201) and the regenerative heat exchanger (92) and then introduced into the humidity-control-side passages (85) of the second portion (202).

In the humidity-control-side passages (85) of the second portion (202), the adsorbent is heated by the second air and water vapor is desorbed from the adsorbent. In other words, regeneration of the adsorbent is carried out. Water vapor desorbed from the adsorbent is applied to the second air. The second air humidified in the humidity-control-side passages (85) of the second portion (202) is sent out to the central air flow path (212).

During the dehumidifying operation, the first air dehumidified and flowing through the left air flow path (213) is supplied into the room and the second air humidified and flowing through the central air flow path (212) is discharged outside the room. During the humidifying operation, the second air humidified and flowing through the central air flow path (212) is supplied into the room and the first air dehumidified and flowing through the left air flow path (213) is discharged outside the room.

<<Second Operation>>

The first operation is continued for a while and then, the second operation is carried out. In the second operation, an adsorbing operation with regard to the second portion (202) of the adsorbing element (200) and a regenerating operation with regard to the first portion (201) are carried out.

In order to switch from the first operation to the second operation, the adsorbing element (200) slides to the right side in FIG. 5(*b*) as shown in this drawing. The adsorbing element (200) is brought into a state in which the first portion (201) extends across the central air flow path (212) and the second portion (202) extends across the right air flow path (211) and the right cooling air flow path (214).

In this state, in the second portion (202) of the adsorbing element (200), the first air is introduced into the humidity-control-side passages (85) and the second air is introduced into the cooling-side passages (86). In the humidity-control-side passages (85) of the second portion (202), water vapor included in the first air is adsorbed by the adsorbent. The first air dehumidified in the humidity-control-side passages (85) of the second portion (202) is sent to the right air flow path (211).

When the water vapor is adsorbed by the adsorbent in the humidity-control-side passages (85), heat of adsorption is generated. This heat of adsorption is absorbed by the second air flowing through the cooling-side passages (86) of the second portion (202). In other words, the second air flows through the cooling-side passages (86) as cooling fluid.

The second air which has absorbed the heat of adsorption in the humidity-control-side passages (85) of the second portion (202) further absorbs heat of condensation of the refrigerant in the regenerative heat exchanger (92) and is introduced into the humidity-control-side passages (85) of the first portion (201). In other words, the second air is heated both in the cooling-side passages (86) of the second portion (202) and the regenerative heat exchanger (92) and then introduced into the humidity-control-side passages (85) of the first portion (201).

In the humidity-control-side passages (85) of the first portion (201), the adsorbent is heated by the second air and water vapor is desorbed from the adsorbent. In other words, regeneration of the adsorbent is carried out. Water vapor desorbed from the adsorbent is applied to the second air. The second air humidified in the humidity-control-side passages (85) of the first portion (201) is sent out to the central air flow path (212).

During the dehumidifying operation, the first air dehumidified and flowing through the right air flow path (211) is supplied into the room and the second air humidified and flowing through the central air flow path (212) is discharged outside the room. During the humidifying operation, the second air humidified and flowing through the central air flow path (212) is supplied into the room and the first air dehumidified and flowing through the right air flow path (211) is discharged outside the room.

As described above, in the second operation, the first air is dehumidified in the second portion (202) of the adsorbing element (200) and the adsorbent is regenerated in the first portion (201). After the second operation is continued for a while, the first operation is carried out again.

<Embodiment 4 of the Invention>

A humidity control apparatus according to the fourth embodiment of the invention includes one adsorbing element (250). The humidity control apparatus takes in first air and second air and carries out an adsorbing operation and a regenerating operation with regard to one adsorbing element (250) in parallel with each other. In other words, in the humidity control apparatus of the present embodiment, dehumidification of air by the adsorbing element (250) and regeneration of adsorbent of the adsorbing element (250) are carried out simultaneously in parallel.

Figure 6:
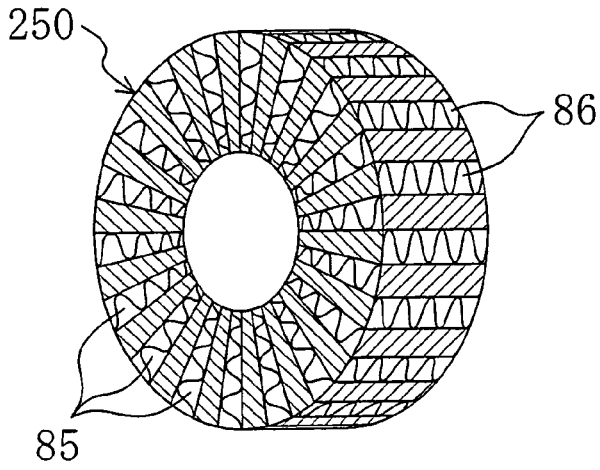
FIG. 6 is a schematic perspective view showing an adsorbing element of a humidity control apparatus according to an embodiment 4.

As shown in FIG. 6, the adsorbing element (250) of the embodiment is formed in a shape of a doughnut or a thick-walled cylinder. In the adsorbing element (250), humidity-control-side passages (85) and cooling-side passages (86) are defined alternately in a circumferential direction of the adsorbing element (250). The humidity-control-side passages (85) pass through the adsorbing element (250) in an axial direction of the adsorbing element (250). In other words, the humidity-control-side passages (85) are open in a front face and a back face of the adsorbing element (250). Inner walls of the humidity-control-side passages (85) are coated with an adsorbent. On the other hand, the cooling-side passages (86) pass through the adsorbing element (250) in a radial direction of the adsorbing element (250). In other words, the cooling-side passages (86) are open in an outer peripheral face and an inner peripheral face of the adsorbing element (250).

Figure 7:
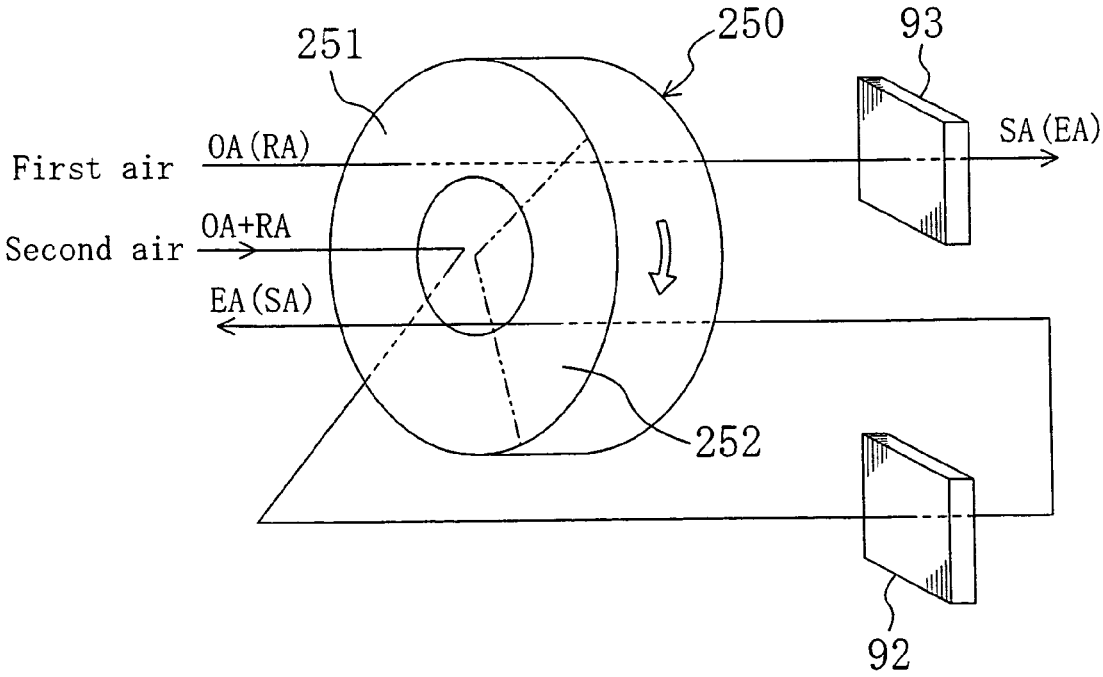
FIG. 7 is a schematic block diagram showing a structure of the humidity control apparatus according to the embodiment 4.

As shown in FIG. 7, in the humidity control apparatus, the adsorbing element (250) is disposed astride an adsorption zone (251) and a regeneration zone (252). The adsorbing element (250) is continuously driven for rotation about an axis passing through a center of the adsorbing element (250).

The humidity control apparatus includes a refrigerant circuit. The refrigerant circuit is a closed circuit formed by connecting a compressor, a regenerative heat exchanger (92) as a condenser, an expansion valve as an expansion mechanism, and a cooling heat exchanger (93) as an evaporator through piping. The regenerative heat exchanger (92) forms a heater. The refrigerant circuit is formed such that a refrigerant filled in the circuit is circulated to carry out a refrigeration cycle of a vapor-compression type. In FIG. 7, only the regenerative heat exchanger (92) and cooling heat exchanger (93) are shown.

In the above humidity control apparatus, a mixture of room air and outside air is used as second air. The humidity control apparatus is provided with a temperature sensor for detecting a temperature of the room air and a temperature sensor for detecting a temperature of the outside air. The humidity control apparatus adjusts a mixture ratio between the room air and the outside air constituting the second air based on temperatures detected by both the temperature sensors. In these points, the embodiment is similar to the above embodiment 1.

Operation

The humidity control apparatus takes in the first air and the second air and carries out the dehumidifying operation and the humidifying operation while switching between the operations. The humidity control apparatus takes in the outside air as the first air during the dehumidifying operation and takes in the room air as the first air during the humidifying operation. On the other hand, the humidity control apparatus uses the mixture of the room air and the outside air as the second air during both the dehumidifying and humidifying operations. Operation for adjusting mixture of the room air and the outside air is similar to that in the embodiment 1.

In the humidity control apparatus, in a portion of the adsorbing element (250) positioned in the adsorption zone (251), the first air is introduced into the humidity-control-side passages (85) of this portion and the second air is introduced into the cooling-side passages (86) of this portion. At this time, the second air is sent into the cooling-side passages (86) from the inner peripheral face of the adsorbing element (250).

In the adsorption zone (251), water vapor included in the first air is adsorbed by an adsorbent in the humidity-control-side passages (85) of the adsorbing element (250). When the water vapor is adsorbed by the adsorbent in the humidity-control-side passages (85), heat of adsorption is generated. The heat of adsorption is absorbed by the second air flowing through the cooling-side passages (86) of the adsorbing element (250).

The first air dehydrated and dehumidified in the adsorption zone (251) passes through the cooling heat exchanger (93). In the cooling heat exchanger (93), the first air carries out heat exchange with the refrigerant and radiates heat to the refrigerant. During the dehumidifying operation, the dehumidified and cooled first air is supplied into the room. During the humidifying operation, the first air which has been dehydrated and heat of which has been radiated is discharged outside the room.

On the other hand, the second air which has taken heat of adsorption in the adsorption zone (251) passes through the regenerative heat exchanger (92). In the regenerative heat exchanger (92), the second air carries out heat exchange with the refrigerant and absorbs heat of condensation of the refrigerant. The second air heated in the adsorption zone (251) and the regenerative heat exchanger (92) is introduced into the humidity-control-side passages (85) of the adsorbing element (250) positioned in the regeneration zone (252). As the adsorbing element (250) rotates, the portion of the adsorbing element (250) which has been positioned in the adsorption zone (251) moves into the regeneration zone (252).

In the portion of the adsorbing element (250) positioned in the regeneration zone (252), the adsorbent is heated by the second air and water vapor is desorbed from the adsorbent in the humidity-control-side passages (85) of this portion. In other words, regeneration of the adsorbent is carried out. Water vapor desorbed from the adsorbent is applied to the second air. The second air is discharged outside the room together with the water vapor desorbed from the adsorbent during the dehumidifying operation. The heated and humidified second air is supplied into the room during the humidifying operation.

<Embodiment 5 of the Invention>

A humidity control apparatus according to the embodiment 5 of the invention is formed by connecting two adsorptive heat exchangers (311, 312) to a refrigerant circuit (300) for carrying out a refrigeration cycle. The humidity control apparatus carries out a dehumidifying operation and a humidifying operation while switching between the operations by taking in first air and second air and supplying one of them to the first adsorptive heat exchanger (311) and the other to the second adsorptive heat exchanger (312).

Figure 8:
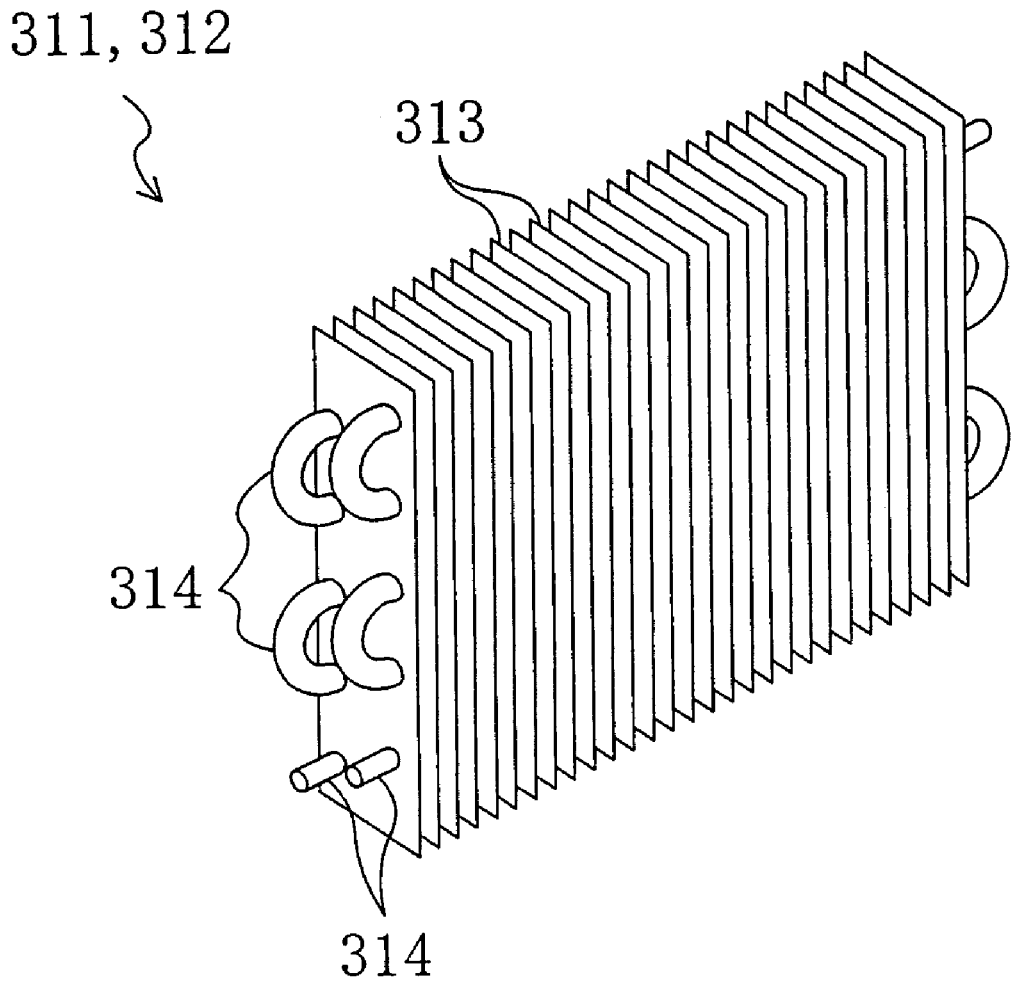
FIG. 8 is a pipeline diagram showing a structure of a humidity control apparatus according to an embodiment 5.

As shown in FIG. 8, in the refrigerant circuit (300), a compressor (301), a four-way selector valve (303), and an expansion valve (302) are provided in addition to the first and second adsorptive heat exchangers (311, 312). The refrigerant circuit (300) is filled with the refrigerant. The refrigerant circuit (300) is formed such that the refrigerant is circulated to carry out a refrigeration cycle of a vapor-compression type.

In the refrigerant circuit (300), a discharge side of the compressor (301) is connected to a first port of the four-way selector valve (303) and a suction side of the compressor (301) is connected to a second port of the four-way selector valve (303) through piping. An end of the first adsorptive heat exchanger (311) is connected to a third port of the four-way selector valve (303) through piping. The other end of the first adsorptive heat exchanger (311) is connected to an end of the second adsorptive heat exchanger (312) through the expansion valve (302) through piping. The other end of the second adsorptive heat exchanger (312) is connected to a fourth port of the four-way selector valve (303) through piping.

The four-way selector valve (303) is switched between a state (a state shown in FIG. 8(*a*)) in which the first port and the fourth port communicate with each other and the second port and the third port communicate with each other and a state (a state shown in FIG. 8(*b*)) in which the first port and the third port communicate with each other and the second port and the fourth port communicate with each other. By operating the four-way selector valve (303), a switch between a first operation in which the second adsorptive heat exchanger (312) becomes a condenser and the first adsorptive heat exchanger (311) becomes an evaporator and a second operation in which the first adsorptive heat exchanger (311) becomes the condenser and the second adsorptive heat exchanger (312) becomes the evaporator is carried out.

Figure 9:
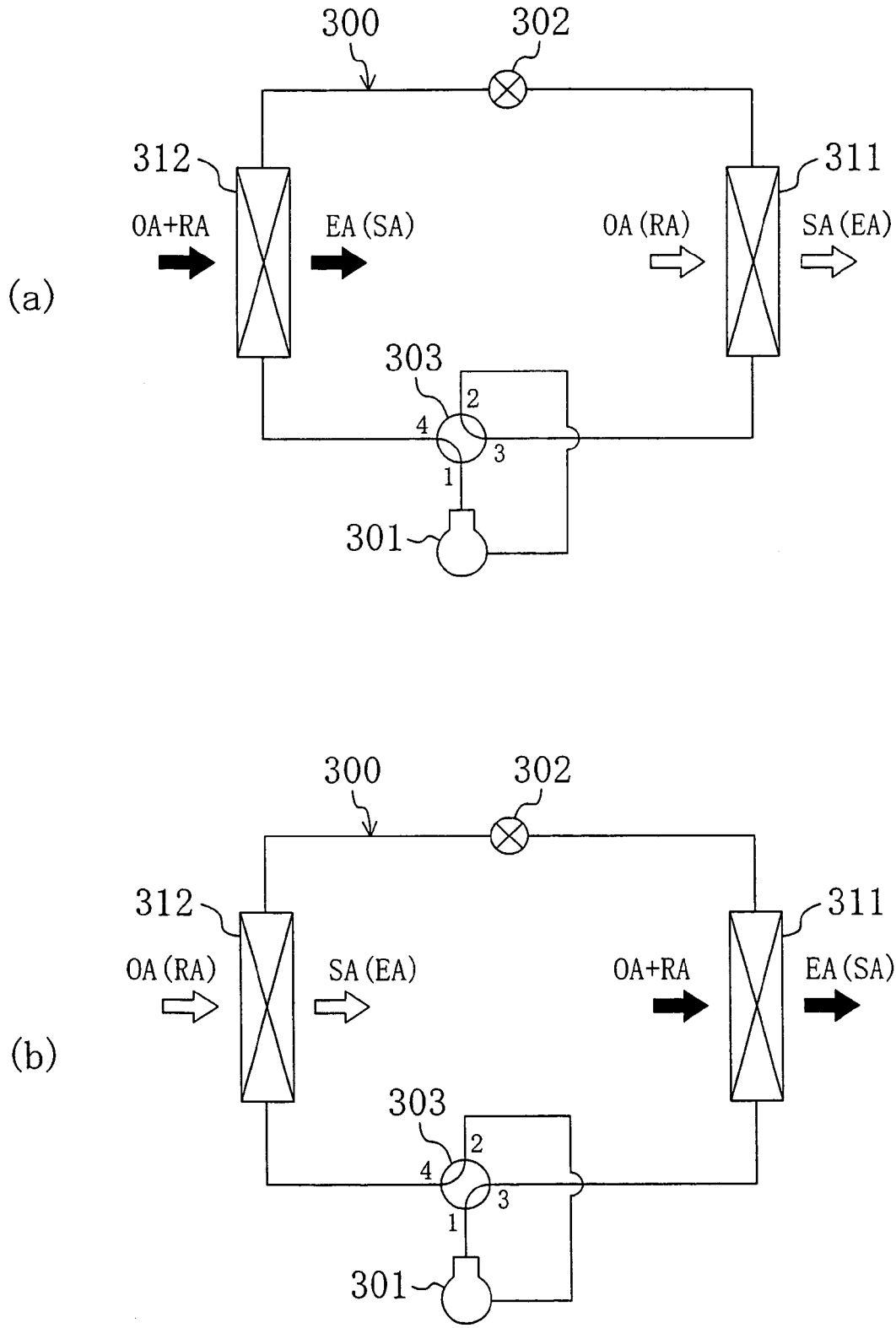
FIGS. 9(*a*) and 9(*b*) are schematic perspective view showing an adsorptive heat exchanger of a humidity control apparatus according to the embodiment 5.

As shown in FIG. 9, each of the first and second adsorptive heat exchangers (311, 312) is formed of a fin-tube heat exchanger of a cross-fin type. To put is concretely, the first and second adsorptive heat exchangers (311, 312) includes a large number of fins (313) formed in a shape of a rectangular plate and made of aluminum and heat exchanger tubes (314) passing through the fins (313) and made of copper. A surface of each the fin (313) is coated with an adsorbent. The first and second adsorptive heat exchangers (311, 312) form adsorbing elements in which air flowing between the fins (313) is brought into contact with the adsorbent and the adsorbent on the surfaces of the fins (313) is heated or cooled by a refrigerant flowing through the heat exchanger tubes (314).

In the humidity control apparatus, a mixture of room air and outside air is used as second air. The humidity control apparatus is provided with a temperature sensor for detecting a temperature of the room air and a temperature sensor for detecting a temperature of the outside air. The humidity control apparatus adjusts a mixture ratio between the room air and the outside air constituting the second air based on temperatures detected by both the temperature sensors. In these points, the embodiment is similar to the above embodiment 1.

Operation

As described above, the humidity control apparatus takes in the first air and the second air and carries out the dehumidifying operation and the humidifying operation while switching between the operations. The humidity control apparatus carries out the dehumidifying operation and the humidifying operation by alternately repeating a first operation and a second operation.

The humidity control apparatus takes in the outside air as the first air during the dehumidifying operation and takes in the room air as the first air during the humidifying operation. On the other hand, the humidity control apparatus uses a mixture of the room air and the outside air as the second air during both the dehumidifying operation and humidifying operation. Operation for adjusting mixture of the room air and the outside air is similar to that in the embodiment 1.

<<First Operation>>

In the first operation, an adsorbing operation with regard to the first adsorptive heat exchanger (311) and a regenerating operation with regard to the second adsorptive heat exchanger (312) are carried out. In other words, in the first operation, moisture in the first air is adsorbed by the first adsorptive heat exchanger (311) and moisture desorbed from the second adsorptive heat exchanger (312) is applied to the second air.

As shown in FIG. 8(*a*), during the first operation, the first air is supplied to the first adsorptive heat exchanger (311) and the second air is supplied to the second adsorptive heat exchanger (312). The four-way selector valve (303) is switched to a state shown in this drawing. In the refrigerant circuit (300), the second adsorptive heat exchanger (312) functions as a condenser and the first adsorptive heat exchanger (311) functions as an evaporator to carry out a refrigeration cycle.

The high-temperature and high-pressure refrigerant discharged from the compressor (301) is sent to the second adsorptive heat exchanger (312) as a heating medium for heating. In the second adsorptive heat exchanger (312), the adsorbent on the surfaces of the fins (313) is heated by the introduced refrigerant. Moisture is desorbed from the heated adsorbent and is applied to the second air. The second air applied with the moisture in the second adsorptive heat exchanger (312) is discharged outside the room during the dehumidifying operation and supplied into the room during the humidifying operation.

The refrigerant which has radiated heat and has been condensed in the second adsorptive heat exchanger (312) is decompressed by the expansion valve (302). The refrigerant after decompression is introduced into the first adsorptive heat exchanger (311) as a heating medium for cooling. Into the first adsorptive heat exchanger (311), the first air is sent. The moisture in the first air is adsorbed by the adsorbent of the first adsorptive heat exchanger (311) and heat of adsorption is generated at this time. The refrigerant flowing into the first adsorptive heat exchanger (311) absorbs the heat of adsorption and evaporates.

The first air dehydrated in the first adsorptive heat exchanger (311) is supplied into the room during the dehumidifying operation and discharged outside the room during the humidifying operation. On the other hand, the refrigerant which has evaporated in the first adsorptive heat exchanger (311) is drawn into the compressor (301). The compressor (301) compresses the drawn refrigerant and discharges it.

<<Second Operation>>

The first operation is continued for a while and then, the second operation is carried out. In the second operation, an adsorbing operation with regard to the second adsorptive heat exchanger (312) and a regenerating operation with regard to the first adsorptive heat exchanger (311) are carried out.

In order to switch from the first operation to the second operation, a switch of air supplied to the adsorptive heat exchangers (311, 312) and an operation of the four-way selector valve (303) are carried out. As shown in FIG. 8(*b*), during the second operation, the second air is supplied to the first adsorptive heat exchanger (311) and the first air is supplied to the second adsorptive heat exchanger (312). The four-way selector valve (303) is switched to a state shown in this drawing. In the refrigerant circuit (300), the first adsorptive heat exchanger (311) functions as a condenser and the second adsorptive heat exchanger (312) functions as an evaporator to carry out a refrigeration cycle.

The high-temperature and high-pressure refrigerant discharged from the compressor (301) is sent to the first adsorptive heat exchanger (311) as a heating medium for heating. In the first adsorptive heat exchanger (311), the adsorbent on the surfaces of the fins (313) is heated by the introduced refrigerant. Moisture is desorbed from the heated adsorbent and is applied to the second air. The second air applied with the moisture in the first adsorptive heat exchanger (311) is discharged outside the room during the dehumidifying operation and supplied into the room during the humidifying operation.

The refrigerant which has radiated heat and has been condensed in the first adsorptive heat exchanger (311) is decompressed by the expansion valve (302). The refrigerant after decompression is introduced into the second adsorptive heat exchanger (312) as a heating medium for cooling. Into the second adsorptive heat exchanger (312), the first air is sent. The moisture in the first air is adsorbed by the adsorbent of the second adsorptive heat exchanger (312) and heat of adsorption is generated at this time. The refrigerant flowing into the second adsorptive heat exchanger (312) absorbs the heat of adsorption and evaporates.

The first air dehydrated in the second adsorptive heat exchanger (312) is supplied into the room during the dehumidifying operation and discharged outside the room during the humidifying operation. On the other hand, the refrigerant which has evaporated in the second adsorptive heat exchanger (312) is drawn into the compressor (301). The compressor (301) compresses the drawn refrigerant and discharges it.

As described above, in the second operation, the first air is dehumidified in the second adsorptive heat exchanger (312) and the adsorbent of the first adsorptive heat exchanger (311) is regenerated. After the second operation is continued for a while, the first operation is carried out again.

<Other Embodiments of the Invention>

Although the mixture ratio between the room air and the outside air in the second air is adjusted based on the temperatures of the room air and the outside air in the above respective embodiments, the mixture ratio may be adjusted as follows instead of the above method.

First, based on relative humidities of the room air and the outside air, the mixture ratio between the room air and the outside air in the second air may be adjusted. For example, in order to secure an amount of moisture desorbed from the adsorbing elements (81, 82, . . . ) to sufficiently regenerate the adsorbent, the lower relative humidity of the second air introduced into the adsorbing elements (81, 82, . . . ) is advantageous. Therefore, the humidity control apparatus adjusts the mixture ratio between the room air and the outside air in view of the relative humidities of the room air and the outside air such that the relative humidity of the second air becomes low.

It is also possible to adjust the mixture ratio between the room air and the outside air in the second air based on the temperature and the relative humidity of the room air and the temperature and the relative humidity of the outside air. For example, in order to secure an amount of humidification during the humidifying operation, it is required that an absolute humidity of the second air supplied into the room is increased to be as high as possible. On the other hand, if a temperature and a relative humidity of air are known, an absolute humidity of the air can be calculated. Therefore, in such a case, the humidity control apparatus obtains absolute humidities of the room air and the outside air by a computation. Then, the humidity control apparatus increases a proportion of one of the room air and the outside air of a higher absolute humidity so as to increase the absolute humidity of the second air.

Furthermore, in the above embodiments 1 to 4, a temperature of the first air flowing out of the adsorbing elements (81, 82, . . . ) may be used as a parameter for adjusting the mixture ratio between the room air and the outside air in the second air.

In other words, in the adsorbing elements (81, 82, . . . ) of these embodiments, the first air in the humidity-control-side passages (85) and the second air in the cooling-side passages (86) carry out heat exchange with each other. During the dehumidifying operation in the humidity control apparatus of each of these embodiments, the outside air is used as the first air. Therefore, in view of performance of heat exchange of the adsorbing elements (81, 82, . . . ), the temperature of the first air before flowing out into the humidity-control-side passages (85), i.e., the temperature of the outside air can be assumed based on the temperature of the first air after flowing out of the humidity-control-side passages (85) of the adsorbing elements (81, 82, . . . ). Therefore, by using the temperature of the first air after flowing out of the humidity-control-side passages (85) instead of the temperature of the outside air, the mixture ratio between the room air and the outside air can be adjusted based on the temperature of the first air and the temperature of the room air.

On the other hand, during the humidifying operation in the humidity control apparatus of each of these embodiments, the room air is used as the first air. Therefore, in view of performance of heat exchange of the adsorbing elements (81, 82, . . . ), the temperature of the first air before flowing out into the humidity-control-side passages (85), i.e., the temperature of the room air can be assumed based on the temperature of the first air after flowing out of the humidity-control-side passages (85) of the adsorbing elements (81, 82, . . . ). Therefore, by using the temperature of the first air after flowing out of the humidity-control-side passages (85) instead of the temperature of the room air, the mixture ratio between the room air and the outside air can be adjusted based on the temperature of the first air and the temperature of the outside air.

Although only the temperature of the air is taken into consideration in adjusting the mixture ratio in this variation, the relative humidities of the room air and the outside air and the like may be taken into consideration in addition to the temperature.

Although the first and second adsorbing elements (81, 82) are formed into shapes of square columns in the embodiments 1 and 2, the shapes of the adsorbing elements (81, 82) are not limited to the square columns but may be hexagonal columns, for example. In the adsorbing elements (81, 82) in shapes of the hexagonal columns, the humidity-control-side passages (85) are open in a pair of opposed side faces, the cooling-side passages (86) are open in another pair of opposed side faces, and the other pair of opposed side faces are closed.

INDUSTRIAL APPLICABILITY

As described above, the present invention is useful in a humidity control apparatus for controlling a humidity of air.

What is claimed is:

1. A humidity control apparatus comprising:

a plurality of adsorbing elements including a humidity-control-side passage for bringing circulating air into contact with an adsorbent; and a heater for heating air supplied to the humidity-control-side passage of the adsorbing elements for regenerating the adsorbent, the humidity control apparatus carrying out an adsorbing operation for introducing first air into the humidity-control-side passage of the adsorbing elements to cause the adsorbent to adsorb moisture in the first air and a regenerating operation for introducing second air which has been heated in the heater into the humidity-control-side passage of the adsorbing elements to desorb the moisture from the adsorbent, the second air being formed of a mixture of room air and outside air, and the adsorbing elements further including a cooling-side passage through which cooling fluid absorbs heat of adsorption generated in the humidity-control-side passage during the adsorbing operation.

2. The humidity control apparatus according to claim 1, wherein the second air passes through the cooling-side passage of the adsorbing elements as the cooling fluid and is then heated by the heater and introduced into the humidity-control-side passage of the adsorbing elements.

3. The humidity control apparatus according to claim 1 or 2, wherein the humidity control apparatus alternately carries out a first operation for simultaneously carrying out the adsorbing operation by circulating the first air through the humidity-control-side passage of the first adsorbing element and the regenerating operation by circulating the second air through the humidity-control-side passage of the second adsorbing element and a second operation for simultaneously carrying out the adsorbing operation by circulating the first air through the humidity-control-side passage of the second adsorbing element and the regenerating operation by circulating the second air through the humidity-control-side passage of the first adsorbing element.

4. The humidity control apparatus according to claim 1 or 2, wherein one of the adsorbing elements is divided into a first portion and a second portion, and the adsorbing element is slid to thereby alternately switch between carrying out a first operation for simultaneously introducing the first air into the humidity-control-side passage of the first portion as the adsorbing operation and introducing the second air into the humidity-control-side passage of the second portion as the regenerating operation and a second operation for simultaneously introducing the second air into the humidity-control-side passage of the first portion as the regenerating operation and introducing the first air into the humidity-control-side passage of the second portion as the adsorbing operation.

5. The humidity control apparatus according to claim 1 or 2, wherein the adsorbing element is formed in a shape of a disc through which the humidity-control-side passage passes in a thickness direction and is disposed in such an attitude as to extend across both a flow path for the first air and a flow path for the second air, and the adsorbing element rotates around its central axis and introduces the first air into the humidity-control-side passage formed in a portion of the adsorbing element as the adsorbing operation, and introduces the second air into the humidity-control-side passage formed in the rest of the adsorbing element as the regenerating operation.

6. The humidity control apparatus according to claim 1 or 2, wherein a mixture ratio between the room air and the outside air in the second air is adjusted based on a temperature of the room air and a temperature of the outside air.

7. The humidity control apparatus according to claim 1 or 2, wherein a mixture ratio between the room air and the outside air in the second air is adjusted based on a relative humidity of the room air and a relative humidity of the outside air.

8. The humidity control apparatus according to claim 1 or 2, wherein a mixture ratio between the room air and the outside air in the second air is adjusted based on a temperature and a relative humidity of the room air and a temperature and a relative humidity of the outside air.

9. The humidity control apparatus according to claim 1 or 2, wherein an operation in which the outside air is used as the first air is carried out and a mixture ratio between the room air and the outside air in the second air is adjusted based on a temperature of the room air and a temperature of the first air after flowing out of the adsorbing elements during the operation.

10. The humidity control apparatus according to claim 1 or 2, wherein an operation in which the room air is used as the first air is carried out and a mixture ratio between the room air and the outside air in the second air is adjusted based on a temperature of the outside air and a temperature of the first air after flowing out of the adsorbing elements during the operation.

11. The humidity control apparatus comprising:

a plurality of adsorbing elements for bringing air passing through the adsorbing elements into contact with an adsorbent and for heating or cooling the adsorbent by a heating medium, the humidity control apparatus carrying out an adsorbing operation for supplying first air and the heating medium for cooling the adsorbing elements to cause the adsorbent to adsorb moisture in the first air and a regenerating operation for supplying second air and the heating medium for heating to the adsorbing elements to desorb the moisture from the adsorbent, and the second air being formed of a mixture of room air and outside air.

12. The humidity control apparatus according to claim 11, wherein a mixture ratio between the room air and the outside air in the second air is adjusted based on a temperature of the room air and a temperature of the outside air.

13. The humidity control apparatus according to claim 11, wherein a mixture ratio between the room air and the outside air in the second air is adjusted based on a relative humidity of the room air and a relative humidity of the outside air.

14. The humidity control apparatus according to claim 11, wherein a mixture ratio between the room air and the outside air in the second air is adjusted based on a temperature and a relative humidity of the room air and a temperature and a relative humidity of the outside air.

15. A humidity control apparatus comprising:

a plurality of adsorbing elements including a humidity-control-side passage for bringing circulating air into contact with an adsorbent; and a heater for heating air supplied to the humidity-control-side passage of the adsorbing elements for regenerating the adsorbent, the humidity control apparatus carrying out an adsorbing operation for introducing first air into the humidity-control-side passage of the adsorbing elements to cause the adsorbent to adsorb moisture in the first air and a regenerating operation for introducing second air which has been heated in the heater into the humidity-control-side passage of the adsorbing elements to desorb the moisture from the adsorbent, the second air being formed of a mixture of room air and outside air, and the humidity control apparatus alternately carrying out a first operation for simultaneously carrying out the adsorbing operation by circulating the first air through the humidity-control-side passage of the first adsorbing element and the regenerating operation by circulating the second air through the humidity-control-side passage of the second adsorbing element and a second operation for simultaneously carrying out the adsorbing operation by circulating the first air through the humidity-control-side passage of the second adsorbing element and the regenerating operation by circulating the second air through the humidity-control-side passage of the first adsorbing element.

16. A humidity control apparatus comprising:

a plurality of adsorbing elements including a humidity-control-side passage for bringing circulating air into contact with an adsorbent; and a heater for heating air supplied to the humidity-control-side passage of the adsorbing elements for regenerating the adsorbent, the humidity control apparatus carrying out an adsorbing operation for introducing first air into the humidity-control-side passage of the adsorbing elements to cause the adsorbent to adsorb moisture in the first air and a regenerating operation for introducing second air which has been heated in the heater into the humidity-control-side passage of the adsorbing elements to desorb the moisture from the adsorbent, the second air being formed of a mixture of room air and outside air, one of the adsorbing elements being divided into a first portion and a second portion, and the adsorbing element being slid to thereby alternately switch between carrying out a first operation for simultaneously introducing the first air into the humidity-control-side passage of the first portion as the adsorbing operation and introducing the second air into the humidity-control-side passage of the second portion as the regenerating operation and a second operation for simultaneously introducing the second air into the humidity-control-side passage of the first portion as the regenerating operation and introducing the first air into the humidity-control-side passage of the second portion as the adsorbing operation.

* * * * *

UNITED STATES PATENT AND TRADEMARK OFFICE

CERTIFICATE OF CORRECTION

PATENT NO. : 6,959,875 B2
DATED : November 1, 2005
INVENTOR(S) : Tomohiro Yabu et al.

It is certified that error appears in the above-identified patent and that said Letters Patent is hereby corrected as shown below:

Title page,
Item [54], Title, change "HUMIDITY CONTROLLER" to -- HUMIDITY CONTROL APPARATUS --.

Signed and Sealed this

Ninth Day of May, 2006

JON W. DUDAS
*Director of the United States Patent and Trademark Office*